United States Patent [19]

Johnson

[11] 4,132,440

[45] Jan. 2, 1979

[54] LOCKING ARRANGEMENT FOR A HOUSEHOLD REFRIGERATOR

[75] Inventor: Thomas O. Johnson, Louisville, Ky.

[73] Assignee: General Electric Company, Louisville, Ky.

[21] Appl. No.: 834,361

[22] Filed: Sep. 19, 1977

[51] Int. Cl.[2] ..... E05B 15/02; F25D 11/00

[52] U.S. Cl. ..... 292/341.19; 292/DIG. 71; 220/210; 312/214; 312/215

[58] Field of Search ..... 312/215, 214, 138 R; 220/9 G, 210, 467; 292/DIG. 71, 341.19, 341.18

[56] References Cited

U.S. PATENT DOCUMENTS

| | | | |
|---|---|---|---|
| 1,873,528 | 8/1932 | Anstine | 292/341.19 |
| 2,174,987 | 10/1939 | Lickteig | 292/341.18 |
| 2,679,421 | 5/1954 | Anderson | 292/332 |
| 2,886,365 | 5/1959 | Fox et al. | 292/341.18 |
| 3,055,193 | 9/1962 | Smith | 292/DIG. 71 |
| 3,257,139 | 6/1966 | Russell et al. | 292/341.18 |
| 3,790,244 | 2/1974 | Stackhouse | 312/215 |

FOREIGN PATENT DOCUMENTS

| | | | |
|---|---|---|---|
| 1982 | 5/1889 | Sweden | 292/341.19 |

*Primary Examiner*—Mervin Stein
*Assistant Examiner*—Alex Grosz
*Attorney, Agent, or Firm*—Frederick P. Weidner

[57] ABSTRACT

A household refrigerator door is locked in its closed position by a latch, which is rotatably mounted in the door and moved between its locked and unlocked positions by a key. The latch cooperates with a catch, which is mounted on the cabinet exterior of the door gasket. The catch includes a mounting plate which is integral with a portion receiving the latch. The mounting plate is secured to a wall of the cabinet by screws extending through slots in the mounting plate, through elongated holes in the wall of the cabinet and finally into threaded holes in a nutstrip. The slots enable the mounting plate to be adjustable in one direction, and the elongated holes enable movement of the catch in a second direction orthogonal to the first direction.

9 Claims, 4 Drawing Figures

LOCKING ARRANGEMENT FOR A HOUSEHOLD REFRIGERATOR

BACKGROUND AND SUMMARY OF THE INVENTION

In certain situations, it is desired to be able to lock the door or doors of a household refrigerator to prevent food from being taken therefrom by unauthorized persons. In addition to the door being capable of being locked, the door must be capable of being opened and closed without interference by the locking arrangement when the door is not locked.

While it has previously been suggested to lock the door of a home food freezer, the relatively large thickness of the wall of the food freezer has enabled a locking arrangement to be utilized without having any effect on the appearance of the inner liner of the door or without producing sweat on the outer case or wall of the door. However, this locking arrangment cannot be satisfactorily utilized with a household refrigerator cabinet because of the wall of the household refrigerator cabinet being relatively thin.

Specifically, if the locking arrangement utilized with the door of the home food freezer were to be employed in a refrigerator cabinet, it is likely that a catch for the door lock latch would be located in the breaker strip of the refrigerator, requiring a relatively large cutout area in the inner liner of the door. This would produce a number of problems. First, stresses would be produced in the plastic door liner in the vicinity of the cutout. This could lead to premature failure. Secondly, the appearance of the refrigerator door inner liner would be affected. Thirdly, increased thermal leakage could lead to condensation ("sweat") forming on the outer wall of the door. Therefore, the type of locking arrangement employed with a home food freezer in which the breaker strip has a catch cannot be satisfactorily utilized with a household refrigerator.

The present invention satisfactorily solves the foregoing problems through providing a locking arrangement for a household refrigerator cabinet in which the necessity of forming any cutout area in the inner liner of the door is avoided. This greatly reduces the possibility of sweat formation on the outer wall of the door and does not have any effect on the appearance of the door.

The present invention accomplishes this through providing a unique locking arrangement having a latch mounted on the door exterior of the compartment sealing means and a catch mounted on a wall of the refrigerator cabinet exterior of where the sealing means on the door engages the cabinet. Thus, there is no large cutout area formed in the inner liner of the door and there is no possibility of sweat formation on the outer wall of the door.

The latch of the present invention is mounted on the door so that it is retracted within the door whenever the door is unlocked. This avoids any possibility of the latch damaging the cabinet when the latch is in its unlocked position.

Additionally, in household refrigerator cabinets of the two-door type, the alignment of each of the doors is critical. Thus, after the two doors have been properly aligned, it is necessary for any latch and catch of a locking arrangement to be properly aligned.

The present invention meets this requirement through mounting the catch on the end wall of the cabinet so that the catch can be moved in both the horizontal and vertical directions prior to being fixed in position. This enables proper location of the catch irrespective of the position to which the door is moved to produce correct alignment.

Furthermore, the household refrigerator cabinet of the two-door type also requires an anti-sweat heater wire in a return flange at the edge of the outer case of the cabinet. Therefore, since this heater wire is at the edge of the cabinet adjacent the location of the catch, it is necessary that the catch be capable of being mounted without damaging the heater wire, particularly by the mounting screws.

The present invention meets this requirement through utilizing a unique nutstrip to receive the screws mounting the catch on the cabinet. The structure of the nutstrip prevents the screws from engaging the heater wire. At the same time the nutstrip enables the screws to extend into the return flange, if desired.

An object of this invention is to provide a locking arrangement for a household refrigerator door which does not require any holes or cutouts in the door inner liner.

Another object of this invention is to provide a catch of a locking arrangement capable of being adjustably mounted.

This invention relates to the combination of a refrigerator cabinet including a compartment having an opening, a door mounted on the cabinet for closing the opening, at least one of the door and the cabinet having sealing means to seal the opening when the door closes the opening, and locking means to lock the door to the cabinet. The locking means includes a latch mounted on the door, means to move the latch between locked and unlocked positions, and catch means mounted on the cabinet exterior of the location of the sealing means when the door closes the opening with the catch means cooperating with the latch to lock the door to the cabinet when the moving means moves the latch to its locked position.

BRIEF DESCRIPTION OF THE DRAWINGS

The attached drawings illustrate a preferred embodiment of the invention, in which.

DESCRIPTION OF THE PREFERRED EMBODIMENT

Figure 1:
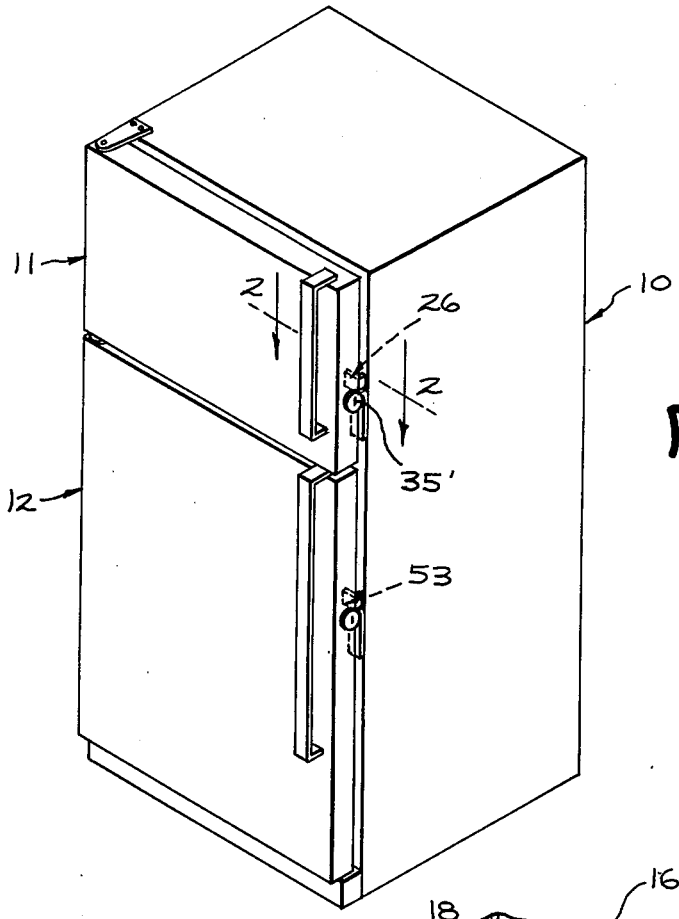
FIG. 1 is a perspective view of a household refrigerator cabinet of the two-door type with each of the doors having the locking arrangement of the present invention.

Referring to the drawings and particularly FIG. 1, there is shown a refrigerator cabinet 10 having an upper or freezer door 11 and a lower or fresh food door 12. Each of the doors 11 and 12 is hingedly mounted on the cabinet 10.

Figure 2:
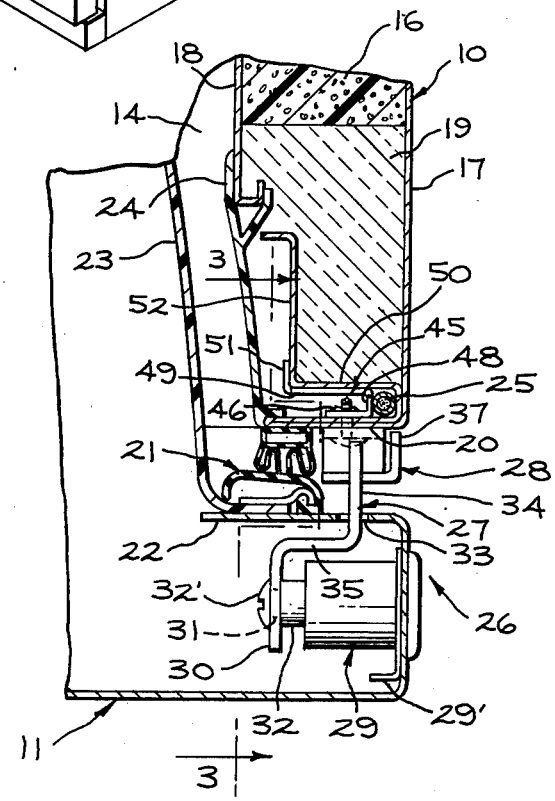
FIG. 2 is a fragmentary sectional view, partly in plan, of a portion of the cabinet of FIG. 1 showing the locking arrangement of the present invention and taken along line 2—2 of FIG. 1.

The upper door 11 closes the opening of a freezer compartment 14 (see FIG. 2). The lower door 12 closes the opening of a fresh food compartment (not shown).

As shown in FIG. 2, the cabinet 10 has foam insulation 16 disposed between its outer case or wall 17 and its inner liner or wall 18. The foam insulation 16 is prevented from leaking out the front face of the cabinet 10 by a fiberglass foam stop element 19.

An end wall 20 which is part of the cabinet flange engages a magnetic gasket seal 21 which is carried by a door return flange 22 of the upper door 11 when the upper door 11 closes the opening of the compartment 14. Thus, the gasket 21 seals the freezer compartment 14. A thermoformed plastic door inner liner 23 which carries shelves (not shown) is attached to the door return flange 22.

To prevent transmission of heat between the outer case 17 and the inner liner 18 of the cabinet 10, a breaker strip 24, which is formed of a heat insulating material such as plastic, for example, connects the end wall 20 to the inner liner 18. To prevent formation of sweat on the outer case 17 of the cabinet 10, a heater wire 25 is disposed adjacent a corner of the outer case 17 and the end wall 20.

A locking arrangement 26 for securing the door 11 to the cabinet 10 when the door 11 is closing the freezer compartment 14 and the seal 21 engages the end wall 20 of the cabinet 10 includes a latch 27 and a catch or keeper 28. The latch 27 is carried generally by the door 11 while the catch 28 is carried by the cabinet 10.

The latch 27 is secured to a lock 29, which is retained in the door 11 by a clip 29', through a first portion 30 of the latch 27 having a rectangular shaped opening to receive a rectangular shaped portion 31 (see FIG. 3) on the end of a reduced cylindrical portion 32 (see FIG. 2) of the lock 29 and to which a screw 32' is secured. Thus, rotation of the reduced cylindrical portion 32 of the lock 29 moves the latch 27 between the phantom and solid line positions of FIG. 3 by the latch 27 passing through a rectangular shaped opening 33 in the return flange 22 of the upper door 11. Only a finger portion 34, which is secured to the first portion 30 by a connecting portion 35 and is substantially parallel to the first portion 30 of the latch 27, passes through the opening 33 as shown in FIG. 2.

The reduced cylindrical portion 32 of the lock 29 is rotated through inserting a key into a key opening 35' (see FIG. 1) in the portion of the lock 29 disposed exterior of the door 11. One suitable example of the lock 29 is sold by National Lock Company as model N4-1100-002-J.

Figure 3:
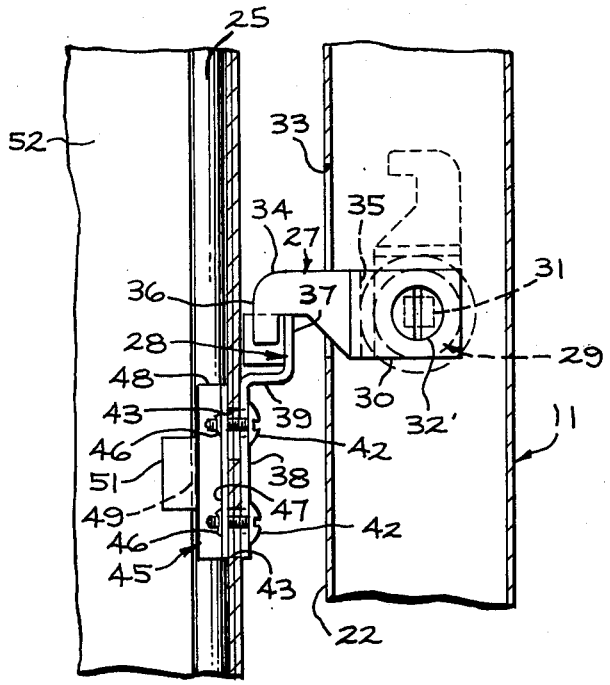
FIG. 3 is a sectional view, partly in elevation, showing the door retained in its closed position by the locking arrangement of the present invention and taken along line 3—3 of FIG. 2.
Figure 4:
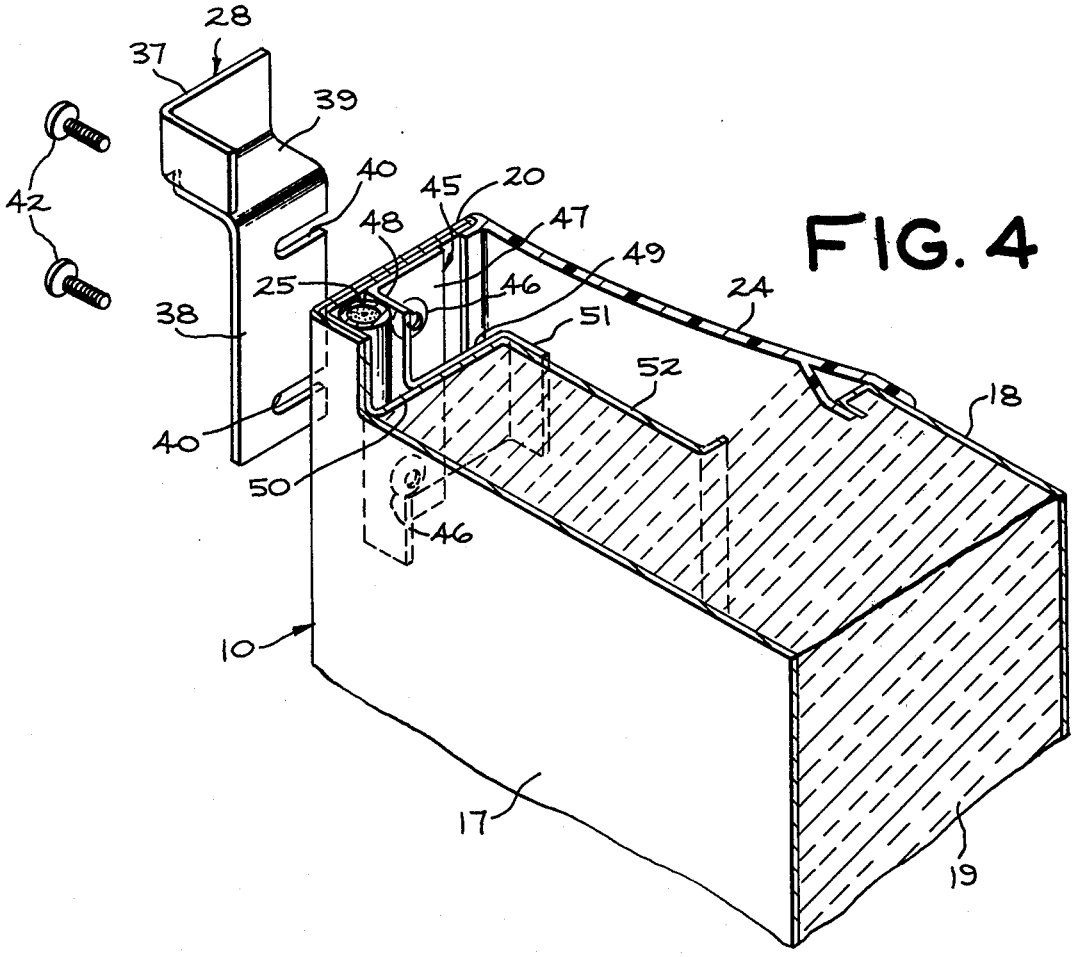
FIG. 4 is a perspective view, partly in section, of a portion of the refrigerator cabinet and showing the catch separated from the cabinet.

The finger portion 34 has its finger end 36 disposed within the catch 28 as shown in FIG. 3. The catch 28 includes an L-shaped upper portion 37 (see FIG. 4), which receives the finger end 36 of the finger portion 34 of the latch 27 as shown in FIG. 3. The L-shaped upper portion 37 is connected to a mounting portion or plate 38 (see FIG. 4) of the catch 28 by a connecting portion or plate 39.

The mounting portion 38 of the catch 28 has a pair of elongated horizontally disposed slots 40 extending inwardly from one side of the mounting portion 38. Each of the slots 40 receives a screw 42 for attaching the catch 28 to the end wall 20 of the cabinet 10. Thus, the position of the catch 28 is adjustable in the horizontal direction relative to the cabinet 10.

Each of the screws 42 extends through an elongated opening or hole 43 (see FIG. 3) in the end wall 20, which comprises a double thickness of metal. The openings 43 are elongated in the vertical direction.

Each of the screws 42 extends through a threaded hole in a nutstrip 45 and a threaded protruding portion 46 on the nutstrip 45 to connect the catch 28 to the cabinet 10 through the end wall 20 and the nutstrip 45. The portion 46 is formed when the threaded hole, which is a helical impression hole, is formed in a first portion 47 of the nutstrip 45.

Adjustment in the vertical direction of both the nutstrip 45 and the catch 28 is accomplished through movement of the screws 42 in the elongated holes or openings 43. Thus, the catch 28 is movable in orthogonal directions (horizontal and vertical) for adjustment of the catch 28 with respect to the latch 27. This adjustment enables the door 11 to be aligned on the cabinet 10 as desired and still have the latch 27 cooperate with the catch 28 to lock the door 11 to the cabinet 10.

It should be understood that the slots 40 in the mounting portion 38 of the catch 28 enable removal of the catch 28 without removing the mounting screws 42. It is only necessary to slightly retract the mounting screws 42 from their tight fit against the catch 28 to remove the catch 28. Thus, while the nutstrip 45 can fall from the location to which it has been positioned by the mounting screws 42 when the mounting screws 42 cease to hold the catch 28, the mounting screws 42 remain connected to the nutstrip 45 so that the nutstrip 45 falls only until the mounting screws 42 abut the bottoms of the elongated openings or holes 43.

The nutstrip 45 has a second portion 48 extending substantially perpendicular to the first portion 47 and substantially parallel to the outer case 17 of the cabinet 10 as shown in FIG. 2. The second portion 48 of the nutstrip 45 prevents the heater wire 25 from being engaged by the screws 42. The nutstrip 45 has a third portion 49, which is substantially parallel to the first portion 47 and connected to one end of the second portion 48 to which it is substantially perpendicular. The third portion 49 has a substantially smaller height than the first portion 47 or the second portion 48 so that the screws 42 can extend into holes (not shown) in a wall 50 of the return flange, if desired, or if necessary because of their length.

The third portion 49 of the nutstrip 45 has a fourth portion 51, which is substantially parallel to the second portion 48 at its end and functions as a tab to bear against a wall 52 of the return flange of the cabinet 10. This prevents the second portion 48 of the nutstrip 45 from compressing the heater wire 25.

Thus, the locking arrangement 26 enables the catch 28 to be adjusted in two orthogonal directions relative to the latch 27. This allows the latch 27 to be received by the catch 28 irrespective of the position to which the door 11 is moved for alignment purposes.

The lower door 12 has a locking arrangement 53 (see FIG. 1), which is the same as the locking arrangement 26. It should be understood that the cabinet 10 does not have the heater wire 25 extending around the fresh food compartment. Due to the relatively higher temperature maintained in the fresh food compartment, sweating is not a particular problem.

It should be understood that the cabinet 10 could have only a single door rather than the two doors. If the cabinet 10 had only a single door, the heater wire 25 probably would not be required. Furthermore, only one of the two doors 11 and 12 could have the locking arrangement, if desired.

An advantage of this invention is that there is no large cutout required in the inner liner of a refrigerator door to provide a latch. Another advantage of this invention is that the catch or keeper is easily adjustable to receive the latch. A further advantage of this invention is that the latch is retractable into the door when the latch is moved to its unlocked position. Still another advantage of this invention is that there is no damage by the catch securing means to any heater wire used to prevent sweat formation on the outer case of the refrigerator. A still further advantage of this invention is that the catch or keeper is mounted so as to be exterior of the sealing means which seal the freezer or fresh food compartment when the door is closed.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. In combination:

a refrigerator cabinet including a compartment having an opening;

a door mounted on said cabinet for closing said opening;

said cabinet having an end wall spaced from said door when said door closes said opening, said end wall defining a side of said opening;

at least one of said door and said cabinet having sealing means to seal said opening when said door closes said opening;

said sealing means having a portion thereof disposed between said end wall of said cabinet and said door; and locking means to lock said door to said cabinet, said locking means including:

a latch disposed interior of the exterior of said door;

means supported on said door to mount said latch;

said supported means including moving means to move said latch between locked and unlocked positions;

said supported means having means to receive a key or the like from exterior of said door to produce movement of said moving means when the key or the like is activated when in said receiving means so that there can always be movement of said latch by said moving means between its locked and unlocked positions; and catch means mounted on said end wall of said cabinet in the space between said end wall of said cabinet and said door and exterior of the location of said sealing means when said door closes said opening;

said catch means cooperating with said latch to lock said door to said cabinet when said moving means moves said latch to its locked position.

2. The combination according to claim 1, including receptacle means within said door for receiving said latch and said moving means moving said latch out of said receptacle means for locking engagement with said catch means and into said receptacle means to prevent said latch from engaging said catch means or said cabinet.

3. The combination according to claim 2, including means to adjustably mount said catch means for adjustable movement in orthogonal directions.

4. The combination according to claim 3, in which said catch means includes a catch for engagement by said latch and mounting means connected to said catch;

said end wall of said cabinet being engageable by said mounting means;

said mounting means having means to allow adjustable movement of said mounting means in one of the orthogonal directions;

said end wall of said cabinet having a pair of elongated holes;

connecting means supported on the opposite side of said end wall of said cabinet from said mounting means and having holes smaller than said elongated holes to enable said connecting means to be moved in the other orthogonal direction while said holes in said connecting means remain aligned with said elongated holes; and securing means extending through said allowing means of said mounting means, said elongated holes in said end wall of said cabinet, and said holes in said connecting means to secure said catch to said cabinet in a position in which said catch engages said latch when said door closes said opening and said moving means moves said catch to its locked position.

5. The combination according to claim 4, in which said refrigerator cabinet has two of said compartments therein and two of said doors, each of said doors closes one of said compartments, and each of said doors is secured to said refrigerator cabinet by one of said locking means.

6. The combination according to claim 5, in which said cabinet has a heater wire adjacent said end wall of said cabinet and one of said compartments, and said connecting means of one of said locking means includes means to prevent said securing means from engaging said heater wire.

7. The combination according to claim 4, in which said supported means includes means to rotatably mount said latch within said receptacle means.

8. The combination according to claim 4, in which said mounting means includes a mounting plate integral with said catch and engageable with said end wall of said cabinet, said mounting plate having said allowing means of said mounting means therein to control movement of said mounting means in the one orthogonal direction.

9. The combination according to claim 1, in which said supported means includes means to rotatably mount said latch interior of the exterior of said door.

* * * * *